US010458081B2

(12) United States Patent
Hayes et al.

(10) Patent No.: US 10,458,081 B2
(45) Date of Patent: Oct. 29, 2019

(54) WORK ATTACHMENT FOR MOTOR GRADER

(71) Applicant: Caterpillar Inc., Peoria, IL (US)

(72) Inventors: Sean Michael Hayes, Decatur, IL (US); Benjamin J. Kovalick, Decatur, IL (US); David L. Cox, Monticello, IL (US); Nathaniel K. Harshman, Sullivan, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/687,568

(22) Filed: Aug. 28, 2017

(65) Prior Publication Data

US 2019/0063021 A1 Feb. 28, 2019

(51) Int. Cl.

| | |
|---|---|
| ***E01H 5/06*** | (2006.01) |
| ***E02F 3/815*** | (2006.01) |
| ***E02F 3/76*** | (2006.01) |

(52) U.S. Cl.

CPC ..... *E01H 5/063* (2013.01); *E01H 5/062* (2013.01); *E02F 3/7636* (2013.01); *E02F 3/8152* (2013.01); *E02F 3/8157* (2013.01)

(58) Field of Classification Search

CPC ..... E01H 5/062; E02F 3/8157
USPC ..... 37/233
See application file for complete search history.

(56) References Cited

U.S. PATENT DOCUMENTS

| | | | | |
|---|---|---|---|---|
| 1,561,368 | A * | 11/1925 | Staley | E01H 5/062 172/817 |
| 1,876,867 | A | 9/1932 | Dean | |
| 2,055,291 | A * | 9/1936 | Henry | E01H 5/062 144/34.1 |
| 3,793,752 | A * | 2/1974 | Snyder | E01H 5/063 172/413 |
| 4,254,564 | A | 3/1981 | Rath | |
| 4,259,794 | A | 4/1981 | Rath | |
| 4,261,115 | A * | 4/1981 | Chittenden | E01H 5/061 172/701.3 |
| 4,794,710 | A * | 1/1989 | Haring | B23K 9/04 37/232 |
| 5,437,113 | A | 8/1995 | Jones | |
| 5,603,172 | A | 2/1997 | Maher | |
| 5,697,172 | A | 12/1997 | Verseef | |

(Continued)

FOREIGN PATENT DOCUMENTS

| | | |
|---|---|---|
| DE | 3205974 | 9/1982 |
| DE | 29500723 | 3/1995 |

(Continued)

*Primary Examiner* — Thomas B Will
*Assistant Examiner* — Joel F. Mitchell

(57) ABSTRACT

A work attachment for a motor grader includes a moldboard and a trip edge assembly coupled to the moldboard. The moldboard defines a plurality of first apertures. The trip edge assembly includes a trip edge structure. The trip edge assembly also includes a pivoting mechanism for pivoting a portion of the trip edge assembly in a first direction with respect to the moldboard when the trip edge assembly encounters an object in a drive path of the motor grader. The trip edge assembly further includes a mounting structure defining a plurality of second apertures. The plurality of second apertures are aligned with the plurality of first apertures to receive mechanical fasteners for removably coupling the trip edge assembly with the moldboard.

17 Claims, 7 Drawing Sheets

(56) References Cited

U.S. PATENT DOCUMENTS

| | | | |
|---|---|---|---|
| 7,143,531 | B2 | 12/2006 | Micozzi |
| 7,658,022 | B2 | 2/2010 | Strait |
| 2011/0314708 | A1 | 12/2011 | Paonessa |

FOREIGN PATENT DOCUMENTS

| | | |
|---|---|---|
| DE | 29500723 | 4/1995 |
| EP | 2708655 | 3/2014 |
| WO | 9523894 | 9/1995 |

* cited by examiner

WORK ATTACHMENT FOR MOTOR GRADER

TECHNICAL FIELD

The present disclosure relates to a work attachment associated with a motor grader.

BACKGROUND

Motor graders include a work attachment that is mounted between a pair of front wheels and a pair of rear wheels of the motor grader. The work attachment includes a moldboard that is coupled to a Drawbar-Circle-Moldboard (DCM) system of the motor grader. When a motor grader is used for a work operation, such as a snow removal operation, the motor grader typically moves quickly with the moldboard forcing against a ground surface or in float. At times, there can be objects present in a drive path of the motor grader that are higher than the ground surface. When such objects are present in the drive path and the moldboard impacts the objects, the impacts of the moldboard with the object can translate forces to components of the motor grader, including the DCM system.

U.S. Pat. No. 7,143,531, hereinafter referred to as the '531 patent, describes a plow protection device. Such a device may, for example, protect a plow against substantial damage from impact with an obstruction such as a utility cover. The plow protection device described in the '531 patent multiplies velocity, distance, and kinetic energy at the point of impact between the plow and the obstruction to lift the plow's cutting edge up and away from the obstruction and the road or other plowing surface. By actively lifting the cutting edge over the impacted obstruction, the plow protection device thereby limits duration and severity of impact and minimizes resulting stresses. Further, the plow protection device includes a wear protector that protects the plow from wear due to friction with the plowing surface. However, the lifting mechanism for lifting and locking the cutting edge above ground level described in the '531 patent includes a number of components and is complex in design and operation.

SUMMARY OF THE DISCLOSURE

In one aspect of the present disclosure, a work attachment for a motor grader is provided. The motor grader includes a moldboard defining a plurality of first apertures. The motor grader also includes a trip edge assembly coupled to the moldboard. The trip edge assembly includes a trip edge structure. The trip edge assembly also includes a pivoting mechanism for pivoting a portion of the trip edge assembly in a first direction with respect to the moldboard when the trip edge assembly encounters an object in a drive path of the motor grader. The trip edge assembly further includes a mounting structure defining a plurality of second apertures. The plurality of second apertures are aligned with the plurality of first apertures to receive mechanical fasteners for removably coupling the trip edge assembly with the moldboard.

In another aspect of the present disclosure, a motor grader is provided. The motor grader includes a frame. The motor grader also includes a drawbar-circle-moldboard system coupled to the frame. The motor grader further includes a work attachment coupled to the drawbar-circle-moldboard system. The work attachment includes a moldboard defining a plurality of first apertures. The motor grader also includes a trip edge assembly coupled to the moldboard. The trip edge assembly includes a trip edge structure. The trip edge assembly also includes a pivoting mechanism for pivoting a portion of the trip edge assembly in a first direction with respect to the moldboard when the trip edge assembly encounters an object in a drive path of the motor grader. The trip edge assembly further includes a mounting structure defining a plurality of second apertures. The plurality of second apertures are aligned with the plurality of first apertures to receive mechanical fasteners for removably coupling the trip edge assembly with the moldboard.

In yet another aspect of the present disclosure, a trip edge assembly for a work attachment associated with a motor grader is provided. The trip edge assembly includes a trip edge structure. The trip edge assembly also includes a pivoting mechanism for pivoting a portion of the trip edge assembly in a first direction with respect to the moldboard when the trip edge assembly encounters an object in a drive path of the motor grader. The trip edge assembly further includes a mounting structure defining a plurality of second apertures. The plurality of second apertures are aligned with the plurality of first apertures to receive mechanical fasteners for removably coupling the trip edge assembly with the moldboard.

Other features and aspects of this disclosure will be apparent from the following description and the accompanying drawings.

DETAILED DESCRIPTION

Figure 1:
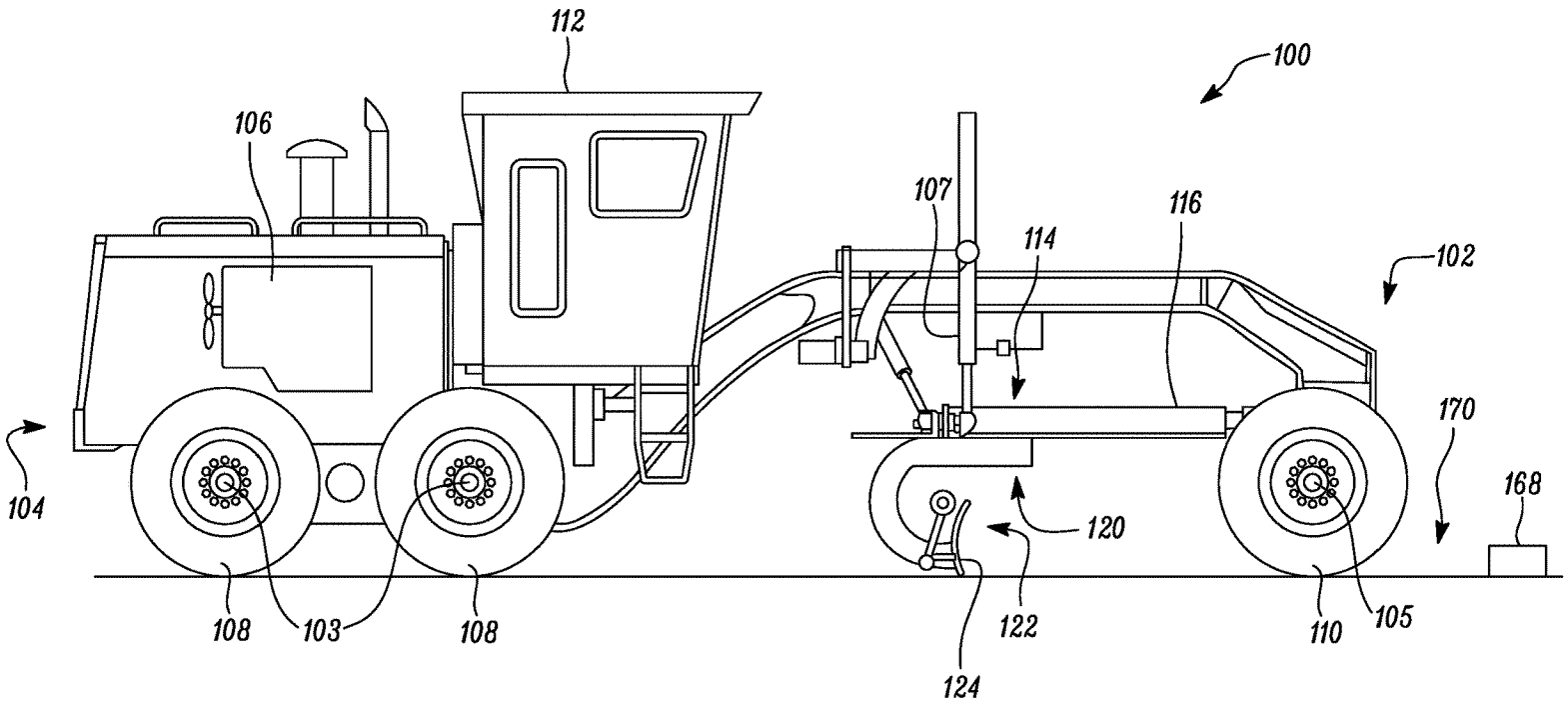
FIG. 1 is a side elevation view of a motor grader, according to one embodiment of the present disclosure.

FIG. 1 is a side elevation view of a motor grader 100, according to an embodiment of the present disclosure. The motor grader 100 may be used to flatten uneven ground surfaces such as during a grading process prior to road construction, moving of snow, debris, and so on. The motor grader 100 includes a main frame 104. The main frame 104 supports various components of the motor grader 100 such as an engine 106, an operator cabin 112, one or more rear axles 103, and rear wheels 108. The motor grader 100 also includes a front frame 102 coupled to the main frame 104. The front frame 102 supports a steerable front axle 105 and front wheels 110, which provides steering to the motor grader 100 on the ground surface.

The front frame 102 also supports a work implement 122. The work implement 122 may be used to perform work operations, such as grading or snow removal. The work implement 122 is positioned between the rear wheels 108 and the front wheels 110. More particularly, the work implement 122 is supported by a drawbar 116 and a circle 120 of a Drawbar-Circle-Moldboard (DCM) system 114. The drawbar 116 and the circle 120 are coupled to the front frame 102. Further, the work implement 122 includes a moldboard 124 and one or more hydraulic cylinders 107 to support or move the moldboard 124.

Figure 2:
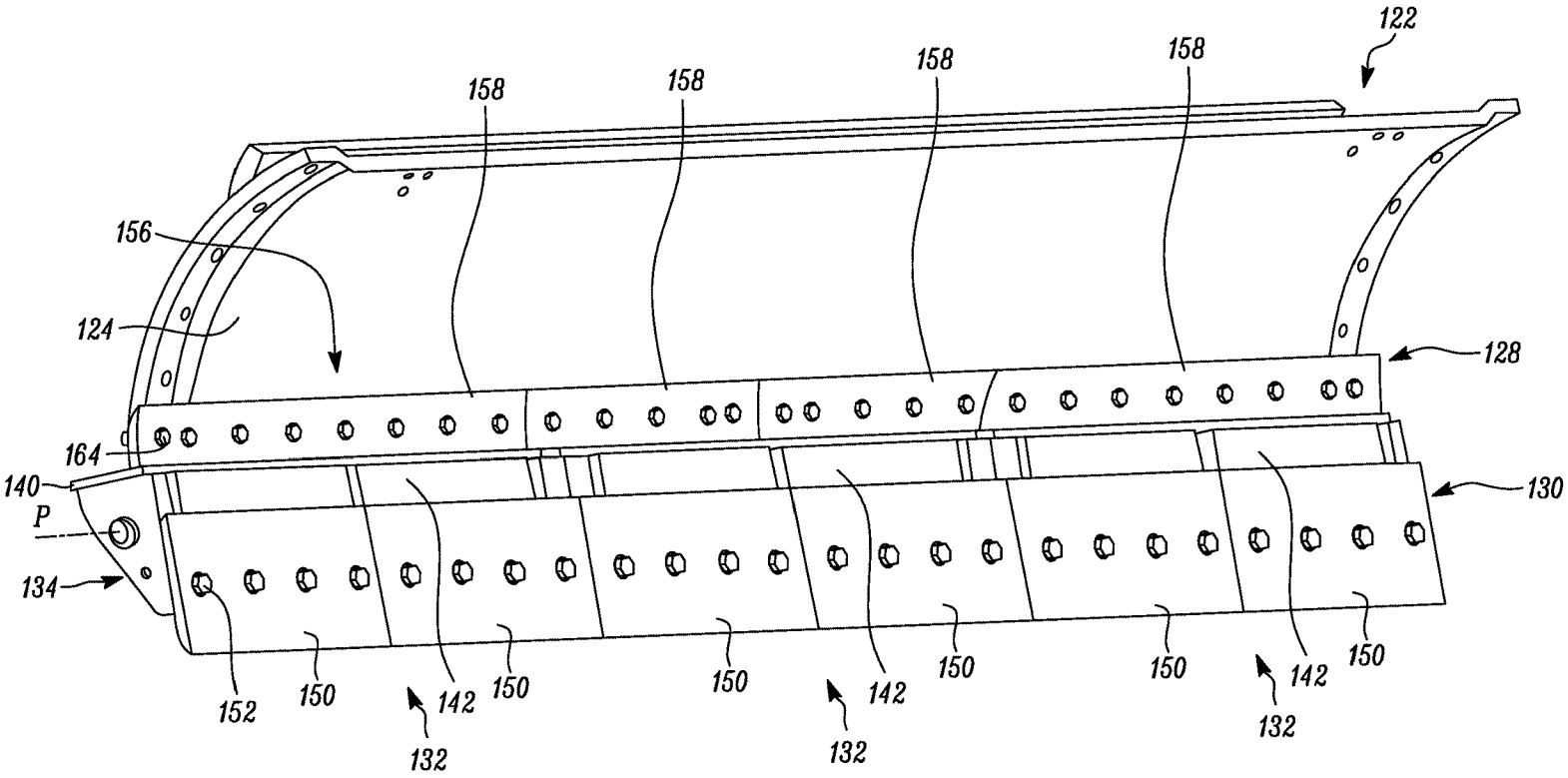
FIG. 2 is a front perspective view of a work attachment associated with the motor grader of FIG. 1.

Referring now to FIG. 2, a front perspective view of the work implement 122 is illustrated. The moldboard 124 includes a number of first apertures 126 (shown in FIG. 3). The first apertures 126 are defined at a lower portion 128 of the moldboard 124. Further, the work implement 122 includes a trip edge assembly 130. The trip edge assembly 130 is coupled to the moldboard 124. The trip edge assembly 130 includes a number of trip edge segments 132. In the illustrated embodiment, the trip edge assembly 130 includes three trip edge segments 132. However, a number of the trip edge segments 132 associated with the trip edge assembly 130 may vary based on application requirements, without limiting the scope of the present disclosure. Each of the three trip edge segments 132 may include generally similar construction and components. For explanatory purposes, details of a single trip edge segment 132 will now be explained in relation to FIGS. 2 to 6.

Figure 3:
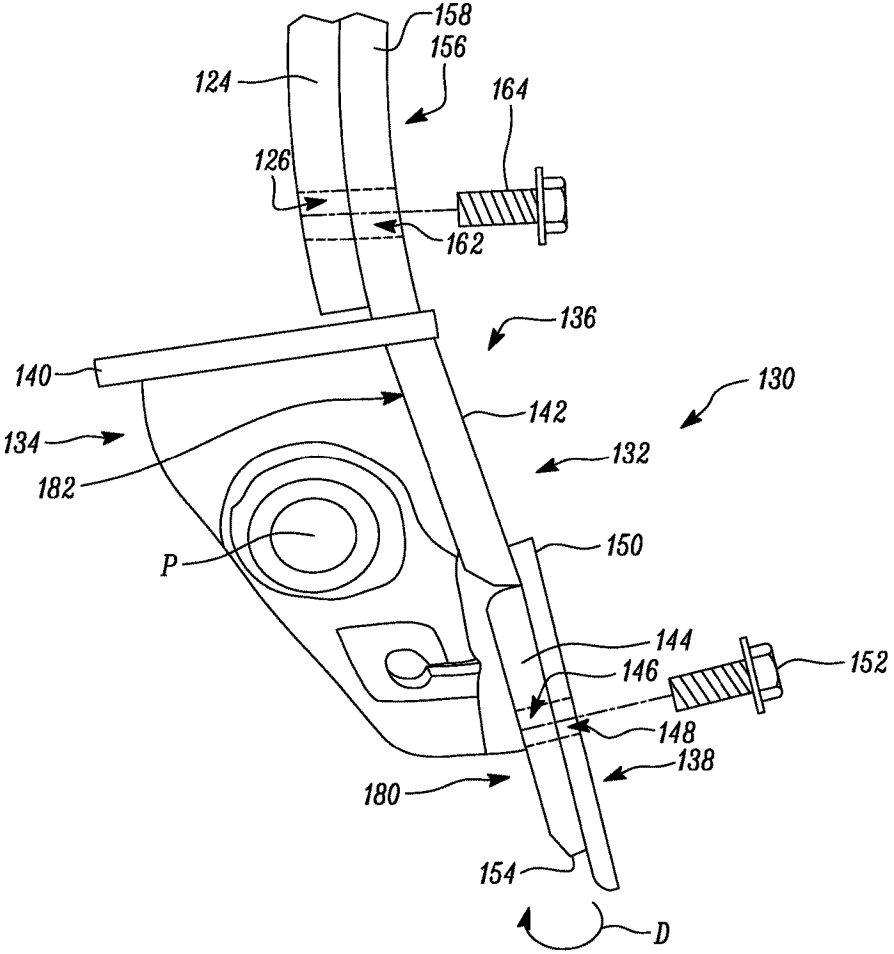
FIG. 3 is a side view of a lateral end portion of a trip edge assembly associated with the work attachment of FIG. 2.

Referring to FIG. 3, the trip edge segment 132 includes a trip edge structure 134. The trip edge structure 134 includes an L-shaped structure having a first section 136 and a second section 138. The second section 138 is pivotally coupled to the first section 136, such that the second section 138 is movable in a first direction "D", with respect to the first section 136. It should be noted that the first direction "D" is defined in a clockwise direction when the motor grader 100 is viewed from a right hand side of the motor grader 100. The first section 136 includes a first plate 140 and a second plate 142. The first and second plates 140, 142 are generally perpendicular to each other, thereby forming an L-shaped first section 136. The first plate 140 is fixedly connected to the second plate 142, and in one example, the first plate 140 may be welded to the second plate 142. Alternatively, the first and second plates 140, 142 may be manufactured as a unitary component.

Further, the second section 138 of the trip edge structure 134 is embodied as a pivotable flap. The second section 138 of the trip edge structure 134 includes a third plate 144. The third plate 144 includes a number of third apertures 146. The third apertures 146 are aligned with apertures 148 defined in a number of cutting edges 150 to receive mechanical fasteners 152. The mechanical fasteners 152 removably couple the cutting edges 150 with the third plate 144 of the second section 138. It should be noted that the mechanical fasteners 152 may embody any one of a bolt, a screw, a rivet, a pin, and the like, without any limitations. When the cutting edges 150 are coupled with the third plate 144, the cutting edges 150 vertically extend downwards and below a lower edge 154 of the third plate 144. In the illustrated embodiment, each trip edge segment 132 includes a pair of cutting edges 150 (see FIG. 2). However, a number of the cutting edges 150 associated with each trip edge segment 132 may vary based on application requirements, without limiting the scope of the present disclosure.

Figure 4:
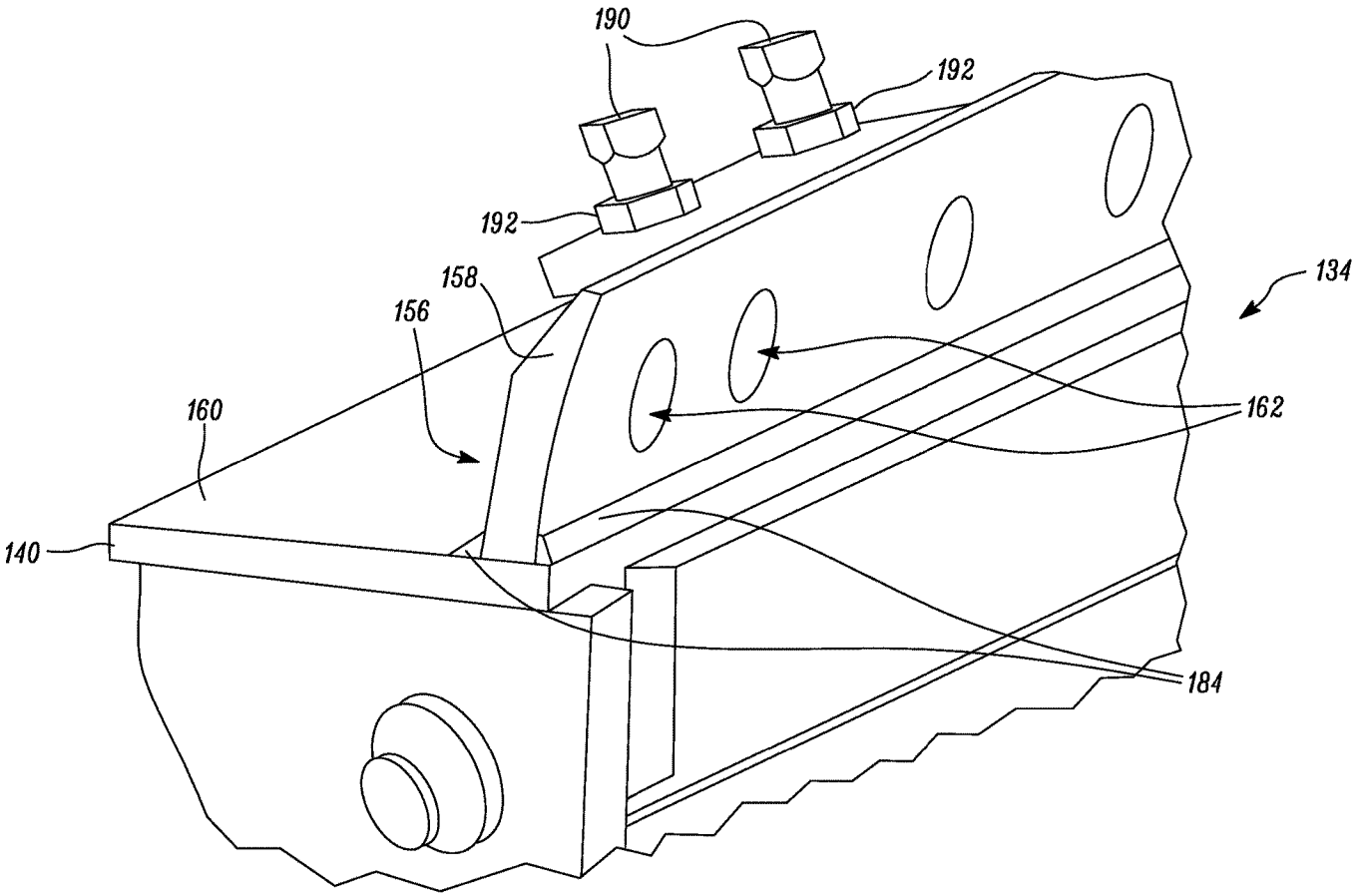
FIG. 4 is a perspective view of a mounting structure for coupling the trip edge assembly with a moldboard of the work attachment, according to one embodiment of the present disclosure.

As shown in FIG. 4, the trip edge segment 132 also includes a mounting structure 156. The mounting structure 156 removably couples the trip edge assembly 130 with the moldboard 124 (see FIG. 2). The mounting structure 156 includes a number of plate members 158. A length of each of the plate member 158 is approximately equal to a length of the first plate 140. Further, a combined length of the plate members 158 is equal to a length of the moldboard 124. The plate members 158 are coupled to an upper surface 160 of the first plate 140 and vertically extend therefrom. In one example, the plate members 158 may be welded to the first plate 140. In the embodiment shown, the plate members 158 are welded to the first plate 140 by fillet welds 184. Alternatively, the plate members 158 can be coupled to the first plate 140 by soldering, brazing, and the like. The plate members 158 define a number of second apertures 162. The second apertures 162 are aligned with the first apertures 126 (see FIG. 3) in the moldboard 124 to receive mechanical fasteners 164 (shown in FIGS. 2 and 3). The mechanical fasteners 164 removably couple the trip edge assembly 130 with the moldboard 124. It should be noted that the mechanical fasteners 164 may embody any one of a bolt, a screw, a rivet, a pin, and the like, without any limitations.

Figure 5:
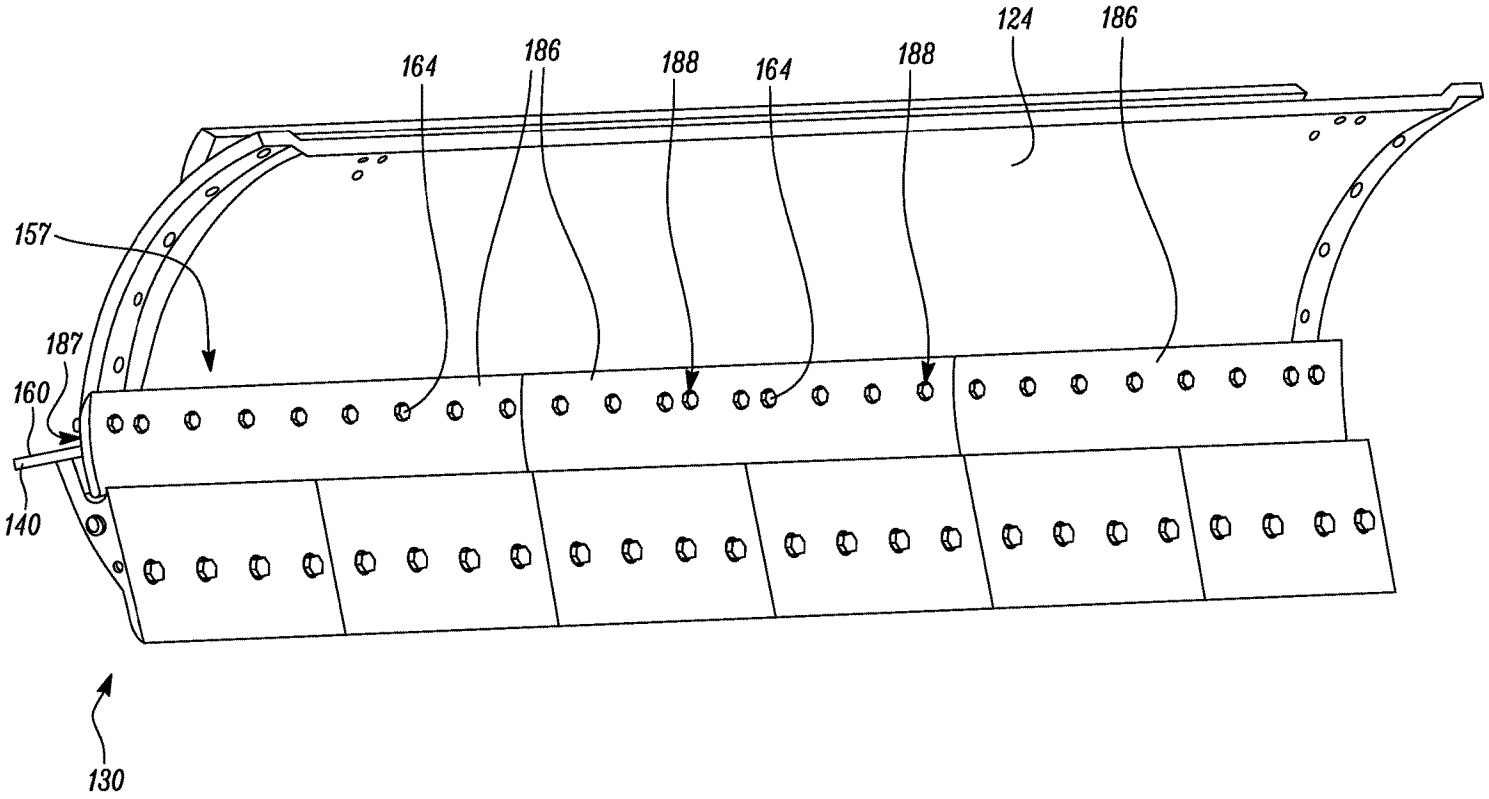
FIG. 5 is a front perspective view of the work attachment having a mounting structure for coupling the trip edge assembly with the moldboard, according to another embodiment of the present disclosure.

FIG. 5 illustrates an alternate embodiment with a mounting structure 157. In this embodiment, the plate members 158 are eliminated and replaced by a number of second plates 186. The second plates 186 are generally similar to the second plates 142 illustrated in FIGS. 2 and 3. In the embodiment shown, the first plate 140 extends perpendicularly from a rear side 187 of the second plates 186, thereby forming a T-shaped structure. In one example, the second plates 186 may be welded to the first plate 140. Further, the second plates 188 include a number of apertures 188. The apertures 188 in the second plates 186 are aligned with the first apertures 126 (see FIG. 3) in the moldboard 124 to receive the mechanical fasteners 164 for removably coupling the trip edge assembly 130 with the moldboard 124.

Figure 6:
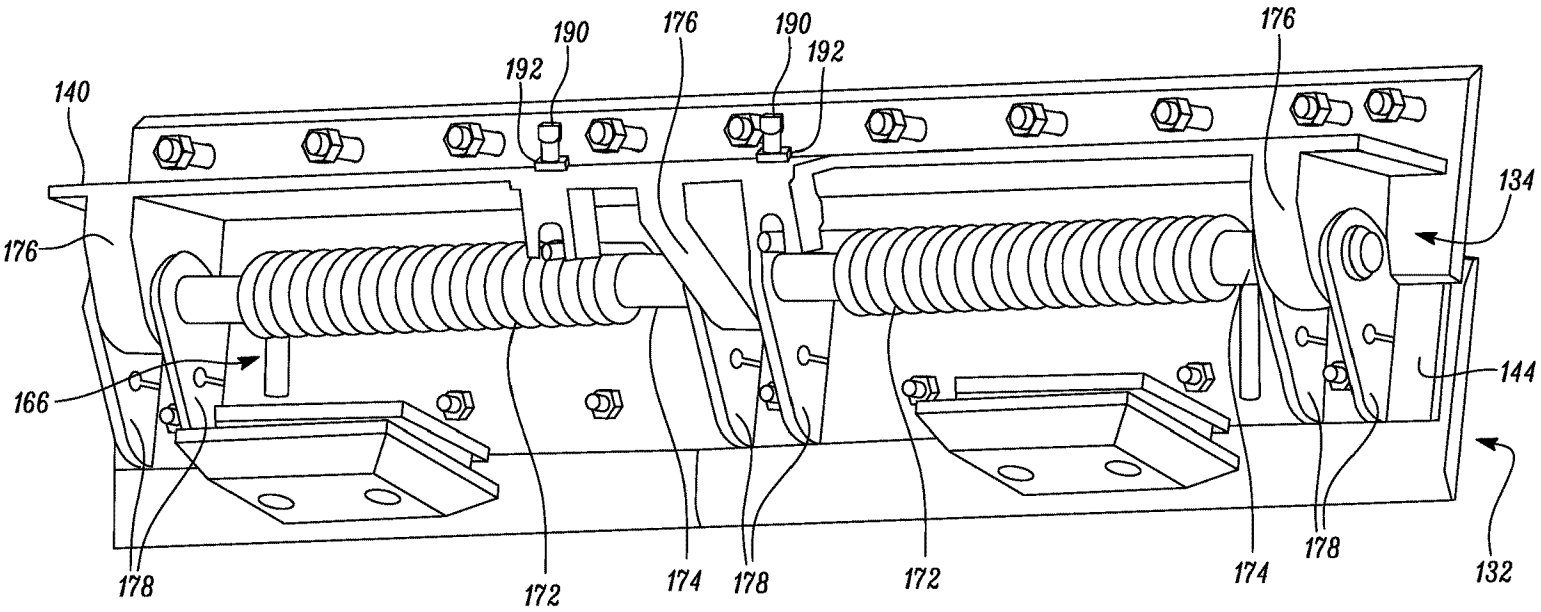
FIG. 6 is a perspective view of a rear side of the trip edge assembly.

Referring now to FIG. 6, the trip edge assembly 130 also includes a number of pivoting mechanisms 166. In one example, the trip edge assembly 130 may include six pivoting mechanisms 166, without limiting the scope of the present disclosure. When the trip edge assembly 130 contacts with an object 168 (shown in FIG. 1) present in a drive path 170 (shown in FIG. 1) of the motor grader 100, the pivoting mechanisms 166 allows a portion of the trip edge assembly 130 to pivot with respect to the moldboard 124. More particularly, the pivoting mechanisms 166 allow the second section 138 and one or more cutting edges 150 to pivot about a pivot axis "P" (shown in FIGS. 2 and 3) in the first direction "D".

Each of the pivoting mechanisms 166 includes one or more spring members 172. The spring members 172 may include a torsion spring, without any limitations. In the illustrated embodiment, each of the pivoting mechanisms 166 includes two spring members 172. Alternatively, the pivoting mechanisms 166 may include a single spring member or more than two spring members 172, without any limitations. The spring members 172 are arranged on respective shafts 174. Each of the shafts 174 is supported by a first pair of brackets 176 and a second pair of brackets 178. The first pair of brackets 176 is fixedly coupled with the first plate 140 of the first section 136. Whereas, the second pair of brackets 178 is fixedly coupled with the third plate 144 of the second section 138. In one example, each of the first and second pair of brackets 176, 178 includes bearing members (not shown). The pivoting mechanism 166 also includes a set screw 190 (shown in FIGS. 4 and 6) and a jam nut 192 (shown in FIGS. 4 and 6) associated with each of the spring members 172. The set screw 190 and the jam nut 192 are used to adjust a tension in the spring member 172. Based on the adjustment in the tension in the spring member 172, a trip force required for pivoting one or more portions of the trip edge assembly 130 can be adjusted.

Further, one end limb (not shown) of the spring members 172 is fixedly connected to a rear side 180 (shown in FIG. 3) of the third plate 144 of the second section 138 and another end limb (not shown) is coupled to a rear side 182 (shown in FIG. 3) of the second plate 142 of the first section 136 so that the second section 138 and the cutting edges 150 are held against an abutment during normal operation of the motor grader 100. In one example, the end limbs can be coupled to the rear sides 182, 180 of the second and third plates 142, 144 by welding, soldering, or brazing.

Figure 7:
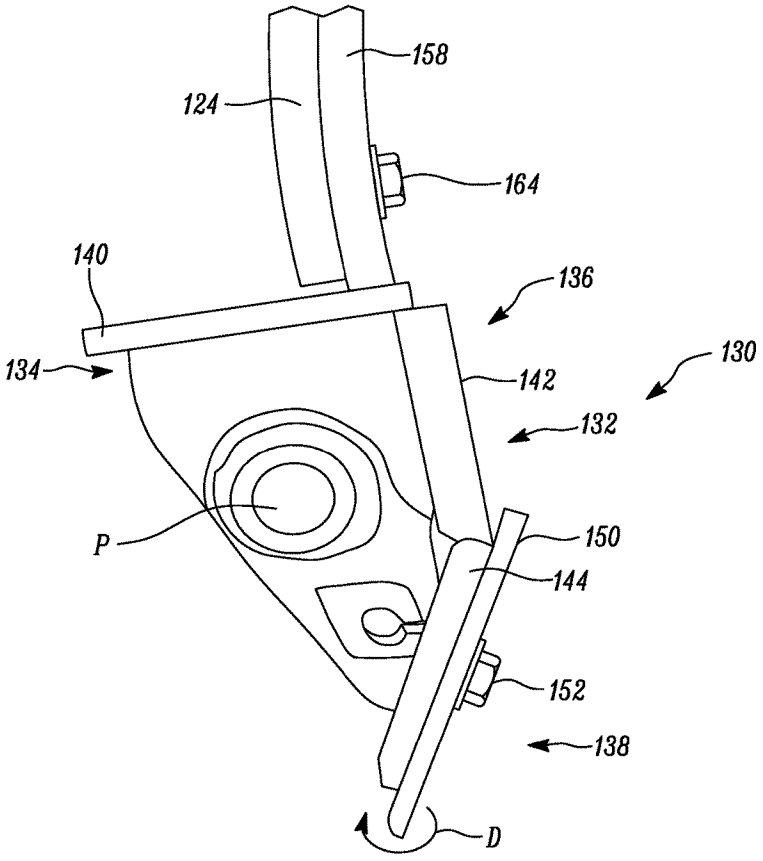
FIG. 7 is a side view of the lateral end portion of the trip edge assembly in a deflected position.

Referring now to FIGS. 1 and 7, when the motor grader 100 encounters the object 168 in the drive path 170, the object 168 exerts a force on the second section 138 and the cutting edge 150 (see FIG. 2) causing the second section 138 and the cutting edge 150 to move against a restoring force of the spring members 172. When the force on the second section 138 and the cutting edge 150 exceeds the restoring force of the spring members 172, the second section 138 and the cutting edge 150 pivots about the pivot axis "P" and move in the first direction "D" to a deflected position. In one example, an angle by which the second section 138 and the cutting edge 150 moves in the first direction "D" is based on specifications of the spring members 172, and the angle can be varied based on specifications of the spring members 172, as per system requirements. Once the second section 138 and the cutting edge 150 passes over the object 168, the restoring force of the spring members 172 causes the second section 138 and the cutting edge 150 to return to their normal positions (shown in FIG. 3).

INDUSTRIAL APPLICABILITY

The present disclosure relates to a trip edge assembly 130 for the work implement 122. As the trip edge assembly design disclosed herein allows the trip edge assembly 130 to pivot and deflect around immovable objects present in the drive path, forces from a possible impact of the work implement 122 with such objects may be diminished. The trip edge assembly 130 may reduce the likelihood of damage to the moldboard 124 and/or deformation of the DCM system 114. Further, each of the trip edge segments 132 of the trip edge assembly 130 includes individual pivoting mechanisms 166. Accordingly, only the trip edge segment that encounters with the object 168 deflects around the object 168 without causing pivoting motion of the remaining trip edge segments.

The trip edge assembly design provides a solution for avoiding impact of the work implement 122 with the objects present in the drive path 170 of the motor grader 100. Also, the trip edge assembly 130 disclosed herein can be retrofitted on an existing work implement without making any modifications to the work implement. Further, the trip edge assembly 130 can be easily coupled with the work implement 122 in field by simply replacing a cutting edge assembly with the trip edge assembly 130.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A work attachment for a motor grader comprising:
- a moldboard defining a plurality of first apertures; and
- a trip edge assembly removably coupled to the moldboard, the trip edge assembly comprising:
  - a trip edge structure including:
    - a first plate having a first end portion and a second end portion opposite the first end portion,
    - a second plate that extends from a first side of the first plate at the second end portion of the first plate, and
    - a third plate that extends from a fourth end of the second plate opposite a third end of the second plate from which the second plate extends from the first side of the first plate;
  - a pivoting mechanism configured to pivot the third plate of the trip edge assembly in a first direction with respect to the moldboard and the second plate when the trip edge assembly encounters an object in a drive path of the motor grader; and
  - a mounting structure welded to the first plate, the mounting structure defining a plurality of second apertures,
  - wherein the plurality of second apertures are aligned with the plurality of first apertures to receive mechanical fasteners to removably couple the trip edge assembly with the moldboard.

2. The work attachment of claim 1, wherein a first section of the trip edge structure includes the first plate and the second plate, the mounting structure vertically extends from a second side of the first plate.

3. The work attachment of claim 1, wherein a second section of the trip edge structure includes the third plate, the third plate defining a plurality of third apertures.

4. The work attachment of claim 3, wherein the plurality of third apertures are aligned with apertures defined in a plurality of cutting edges to receive mechanical fasteners for removably coupling the plurality of cutting edges with the second section.

5. The work attachment of claim 4, wherein the pivoting mechanism is adapted to pivot the second section and the plurality of cutting edges about a pivot axis.

6. The work attachment of claim 1, wherein the pivoting mechanism includes at least one spring member.

7. A motor grader comprising:
- a frame;
- a drawbar-circle-moldboard system coupled to the frame; and
- a work attachment coupled to the drawbar-circle-moldboard system, the work attachment comprising:
  - a moldboard defining a plurality of first apertures; and
  - a trip edge assembly removably coupled to the moldboard, the trip edge assembly comprising:
    - a trip edge structure including:
      - a first section, and
      - a second section that extends from the first section;
    - a pivoting mechanism configured to pivot part of the second section of the trip edge assembly in a first direction with respect to the moldboard and the first section when the trip edge assembly encounters an object in a drive path of the motor grader; and
    - a mounting structure in the form of a plate welded to the first plate, the mounting structure defining a plurality of second apertures, an end of the plate being fixedly coupled to an upper surface of the first section and extending from the upper surface of the first section, wherein the plurality of second apertures are aligned with the plurality of first apertures to receive mechanical fasteners for removably coupling the trip edge assembly with the moldboard, and wherein, when the trip edge assembly is removably coupled to the moldboard, a face of the moldboard directly contacts a face of the plate that forms the mounting structure.

8. The motor grader of claim 7, wherein the first section of the trip edge structure includes a first plate and a second plate, the mounting structure being fixedly coupled to the first plate and vertically extending therefrom.

9. The motor grader of claim 7, wherein the second section of the trip edge structure includes a third plate defining a plurality of third apertures.

10. The motor grader of claim 9, wherein the plurality of third apertures are aligned with apertures defined in a plurality of cutting edges to receive mechanical fasteners for removably coupling the plurality of cutting edges with the second section.

11. The motor grader of claim 10, wherein the pivoting mechanism is adapted to pivot the part of the second section and the plurality of cutting edges about a pivot axis.

12. The motor grader of claim 7, wherein the pivoting mechanism includes at least one spring member.

13. A trip edge assembly for a work attachment associated with a motor grader, the trip edge assembly comprising:

a trip edge structure including:

a first plate having a first end portion and a second end portion opposite the first end portion, a second plate that extends from a first side of the first plate at the second end portion of the first plate, and a third plate that extends from a fourth end of the second plate opposite a third end of the second plate from which the second plate extends from the first side of the first plate;

a pivoting mechanism configured to pivot the third plate of the trip edge assembly in a first direction with respect to the second plate when the trip edge assembly encounters an object in a drive path of the motor grader; and a mounting structure welded to the first plate, the mounting structure defining a plurality of second apertures, wherein the plurality of second apertures are aligned with a plurality of first apertures defined in a moldboard of the work attachment receive mechanical fasteners to removably couple the trip edge assembly with the moldboard.

14. The trip edge assembly of claim 13, wherein a first section of the trip edge structure includes the first plate and the second plate, the mounting structure being fixedly coupled to the first plate and vertically extending therefrom.

15. The trip edge assembly of claim 13, wherein a second section of the trip edge structure includes the third plate, the third plate defining a plurality of third apertures.

16. The trip edge assembly of claim 15, wherein the plurality of third apertures are aligned with apertures defined in a plurality of cutting edges to receive mechanical fasteners for removably coupling the plurality of cutting edges with the second section.

17. The trip edge assembly of claim 16, wherein the pivoting mechanism is adapted to pivot the second section and the plurality of cutting edges about a pivot axis, the pivoting mechanism including at least one spring member.

* * * * *